US007064319B2

(12) United States Patent
Hashimoto et al.

(10) Patent No.: US 7,064,319 B2
(45) Date of Patent: Jun. 20, 2006

(54) MASS SPECTROMETER

(75) Inventors: Yuichiro Hashimoto, Kokubunji (JP); Izumi Waki, Asaka (JP); Kiyomi Yoshinari, Tokyo (JP); Yasushi Terui, Tsuchiura (JP); Tsukasa Shishika, Hitachinaka (JP); Marvin L. Vestal, Farmingham, MA (US)

(73) Assignees: Hitachi High-Technologies Corporation, Tokyo (JP); Applera Corporation, Norwalk, CT (US)

( * ) Notice: Subject to any disclaimer, the term of this patent is extended or adjusted under 35 U.S.C. 154(b) by 0 days.

(21) Appl. No.: 10/401,944

(22) Filed: Mar. 31, 2003

(65) Prior Publication Data

US 2004/0195502 A1 Oct. 7, 2004

(51) Int. Cl.
*H01J 49/42* (2006.01)

(52) U.S. Cl. ..... 250/287; 250/290; 250/291

(58) Field of Classification Search ..... 250/281–292
See application file for complete search history.

(56) References Cited

U.S. PATENT DOCUMENTS

| | | | | |
|---|---|---|---|---|
| 2,939,952 | A | 6/1960 | Paul et al. | |
| 4,736,101 | A | 4/1988 | Syka et al. | |
| 4,963,736 | A * | 10/1990 | Douglas et al. | 250/292 |
| 5,528,031 | A * | 6/1996 | Franzen | 250/282 |
| 6,011,259 | A | 1/2000 | Whitehouse et al. | |
| 6,483,109 | B1 * | 11/2002 | Reinhold et al. | 250/292 |
| 6,504,148 | B1 | 1/2003 | Hager | |
| 6,627,883 | B1 * | 9/2003 | Wang et al. | 250/292 |
| 6,770,871 | B1 * | 8/2004 | Wang et al. | 250/281 |
| 2002/0030159 | A1 | 3/2002 | Chernushevich et al. | |
| 2002/0063211 | A1 | 5/2002 | Hager | |
| 2002/0070338 | A1 | 6/2002 | Loboda | |

FOREIGN PATENT DOCUMENTS

| | | |
|---|---|---|
| EP | 1 365 438 | 11/2003 |
| JP | 2001-297730 | 10/2001 |
| WO | WO 98/06481 | 2/1998 |
| WO | WO 02/48699 | 6/2002 |
| WO | WO 03/103010 | 12/2003 |
| WO | WO 2004/083805 | 9/2004 |

OTHER PUBLICATIONS

Rapid Communications in Mass Spectrometry, vol. 10, pp. 889, 1996, cited in the specification at p. 8.

(Continued)

*Primary Examiner*—Nikita Wells
*Assistant Examiner*—David A. Vanore
(74) *Attorney, Agent, or Firm*—Antonelli, Terry, Stout and Kraus, LLP.

(57) ABSTRACT

A mass spectrometer according to the present invention has an ionization source for generating ions; an ion trap for accumulating the ions; a time-of-flight mass spectrometer for performing mass spectrometry analysis on the ions by use of a flight time; a collision damping chamber disposed between the ion trap and the time-of-flight mass spectrometer and having a plurality of electrodes therein, which produce a multi-pole electric field, wherein a gas is introduced into the collision damping chamber to reduce kinetic energy of the ions ejected from the ion trap; and an ion transmission adjusting mechanism disposed between the ion trap and the collision damping chamber to allow or prevent injection of the ions from the ion trap to the collision damping chamber. The mass spectrometer provides greatly enhanced qualitative and quantitative analysis capabilities, as compared with conventional techniques.

11 Claims, 10 Drawing Sheets

OTHER PUBLICATIONS

Proceedings of the 43rd Annual Conference on Mass Spectrometry and Allied Topics, 1995, cited in the specification at p. 10.
International Journal of Mass Spectrometry, vol. 213, pp. 45-62, 2002, cited in the specification at p. 7.
Proceedings of the 49th ASMS Conference, 2001, cited in the specification at p. 7.
Rev.Sci.Instrum., vol. 63(10), p. 4277-4284, cited in the specification at p. 5.
Morris et al, High Sensitivity Collisionally-activated Decomposition Tandem Mass Spectrometry on a Novel Quadrupole/Orthogonal-acceleration Time-Of-Flight Mass SPectrometer, Rapid Communications in Mass Spectrometry, Heyden, London, vol. 10, 1996 pp. 889-896.

* cited by examiner

MASS SPECTROMETER

BACKGROUND OF THE INVENTION

The present invention relates to a mass spectrometer that is capable of measuring a wide (ion) mass range in a single measuring process without repeating it, while achieving high sensitivity, high mass accuracy, and $MS^n$ analysis.

There has been a need for mass spectrometers that are capable of providing high sensitivity, high mass accuracy, $MS^n$ analysis, etc. in proteome analysis, etc. An example of how these analyses are conventionally carried out will be described.

A quadrupole ion trap mass spectrometer is a high-sensitivity mass spectrometer that is capable of $MS^n$ analysis. The basic principle of the operation of the quadrupole ion trap mass spectrometer is described in U.S. Pat. No. 2,939,952. A quadrupole ion trap is made up of a ring electrode and a pair of endcap electrodes. A radio frequency voltage of approximately 1 MHz is applied to the ring electrode, so that ions whose mass is higher than a predetermined value assume a stable state and can be accumulated within the ion trap. $MS^n$ analysis in an ion trap is described in U.S. Pat. No. 4,736,101 (Re. 34,000). In the system described in U.S. Pat. No. 4,736,101 (Re. 34,000), ions generated by an ionization source are accumulated within an ion trap, and precursor ions of desired mass are isolated (from the accumulated ions). After the isolation, a supplementary AC voltage, which resonates with the precursor ions, is applied between the end cap electrodes. This extends the ion orbit and thereby causes the precursor ions to collide with a neutral gas that has been filled in the ion trap, thereby dissociating the ions. The fragment ions obtained as a result of the dissociation of the precursor ions are detected. The fragment ions provide a spectrum pattern specific to the molecular structure of the precursor ions, making it possible to obtain more detailed structural information on the sample molecules. With this system, however, a mass accuracy of only 100 ppm can be obtained due to occurrence of a chemical mass shift that is attributed to collision with gas at the time of ion detection, a space charge that is attributed to the electrical charges, etc. Therefore, this system cannot be applied to fields in which high mass accuracy is required.

An attempt to achieve both high mass accuracy and $MS^n$ analysis is described in S. M. Michael et al., Rev.Sci.Instrum., 1992, Vol.63(10), p.4277–4284. This system can repeat ion isolation or dissociation within the ion trap to accomplish $MS^n$. Ions ejected from the ion trap are accelerated coaxially into TOF. This arrangement makes it possible to accomplish higher mass accuracy than an ion trap. With this system, however, a mass accuracy of only 50 ppm can be obtained due to the divergence caused from collisions which occur during ion ejection from the ion trap. Therefore, this system cannot be applied to fields in which high mass accuracy is required.

A method of achieving both high mass accuracy and $MS^n$ analysis is described in Japanese Laid-Open Patent Publication No. 2001-297730. This system can repeat ion isolation or dissociation within the ion trap to accomplish $MS^n$. Ions ejected from the ion trap are accelerated in an orthogonal direction in synchronization with their introduction into the acceleration region of the TOF region. This orthogonal arrangement of the ion introduction and ion acceleration directions makes it possible to accomplish high mass accuracy.

However, a new problem is created with this orthogonal ion trap/TOF. The arrival times of the ions reaching the acceleration region after they are ejected from the trap region are different depending on their mass. Suppose that the ions are accelerated at a certain timing (they are accelerated when middle-mass ions have just reached the acceleration region). In such a case, high-mass ions which have not yet reached the acceleration region and low-mass ions which have already passed the acceleration region are not detected. This puts a limit on the ion mass number range which can be accelerated and detected. As a typical example, the ratio of the maximum mass number to the minimum mass number, which can be detected at one time (this ratio is referred to as a mass window), is approximately 2. For example, to cover a mass range of 100 to 10000 amu with the mass window set to 2, it is necessary to divide the mass range into seven or more portions and measure them in parallel. This leads to a reduction in the number of times the measurement can be performed, thereby decreasing the sensitivity.

An attempt to solve the problem resulting from the occurrence of a mass window in the above-described orthogonal TOF is reported in The International Journal of Mass Spectrometry, vol. 213, pp. 45–62, 2002. In the system described in this publication, when ejecting ions, the potential difference between the endcap electrodes is increased while applying the ring voltage. At that time, since the ions are sequentially ejected in the order of decreasing mass, a wide mass range of ions can be introduced into the acceleration region of the TOF at nearly the same time. However, this system is disadvantageous in that the spread in the kinetic energy of low-mass (that is, high q value) ions is as large as nearly 1 kV, thereby considerably reducing the transmission at subsequent stages.

Another attempt to solve the problem resulting from the occurrence of a mass window is reported by C. Marinach (Universite Pierre et Marie Curie), Proceedings of the 49th ASMS Conference, 2001. To solve the above-described problem, this system increases the time taken for ions to travel from the ion trap to the TOF region so as to turn the ion beam into a pseudo-continuous current, as well as increasing the TOF repetition frequency to approximately 10 kHz, in order to measure a wide mass range of ions. However, this system is disadvantageous in that it is necessary to transfer ions a long distance between the ion trap and the TOF acceleration region with low energy, resulting in reduced ion transmission, reduced sensitivity, etc.

On the other hand, a method of achieving high mass accuracy is described in Proceedings of the 43nd Annual Conference on Mass Spectrometry and Allied Topics, 1995, pp. 126. This method sets the ion introduction direction from the ionization source to the TOF analyzer and the acceleration direction of the TOF region such that they are orthogonal to each other, thereby accomplishing high mass accuracy over a wide mass range. Furthermore, an intermediate pressure chamber under a pressure of 10 Pa is provided between the ionization source and the TOF region, and multipole rods (multipole electrode) are disposed therein to carry out collision damping, thereby enhancing the transmission between the ionization source and the TOF region. This system, however, cannot perform MS/MS analysis.

One method of achieving both high mass accuracy and MS/MS analysis is to use the Q-TOF (quadrupole/time-of-flight) mass spectrometer described in Rapid Communications in Mass Spectrometry, Vol. 10, pp. 889, 1996. In this method, ions subjected to mass selection in the quadrupole mass spectrometry region are accelerated and introduced into a collision cell. The introduced ions collide with gas within the collision cell and are thereby dissociated. The collision cell is filled with the gas at a pressure of 10 Pa and has multi-pole rods (multi-pole electrode) disposed therein. The dissociated ions gather toward the center axis direction, due to the action of the multi-pole electric field and the collision with the gas, and they are introduced into the TOF region, making it possible to accomplish MS/MS analysis. However, this system cannot perform $MS^n$ analysis ($n \geqq 3$). Furthermore, since a plurality of types of dissociation occur after the ions are introduced into the collision cell, it may be difficult to estimate the original ion structure from ions generated as a result of the dissociation.

SUMMARY OF THE INVENTION

Prior techniques cannot provide a mass spectrometer that is capable of measuring a wide (ion) mass range in a single measuring process without repeating it, while also achieving high sensitivity, high mass accuracy, and $MS^n$ analysis.

It is, therefore, an object of the present invention to provide a mass spectrometer that is capable of measuring a wide (ion) mass range in a single measuring process without repeating it, and of achieving high sensitivity, high mass accuracy, and $MS^n$ analysis.

A mass spectrometer according to the present invention has an ionization source for generating ions; an ion trap for accumulating the ions; a time-of-flight mass spectrometer for performing mass spectrometry analysis on the ions by use of a flight time; a collision damping chamber disposed between the ion trap and the time-of-flight mass spectrometer and having a plurality of electrodes therein which produce a multi-pole electric field, wherein a gas is introduced into the collision damping chamber to reduce the kinetic energy of the ions ejected from the ion trap; and an ion transmission adjusting mechanism disposed between the ion trap and the collision damping chamber to allow or prevent injection of the ions from the ion trap into the collision damping chamber.

DETAILED DESCRIPTION OF THE PREFERRED EMBODIMENTS

First Embodiment

Figure 1:
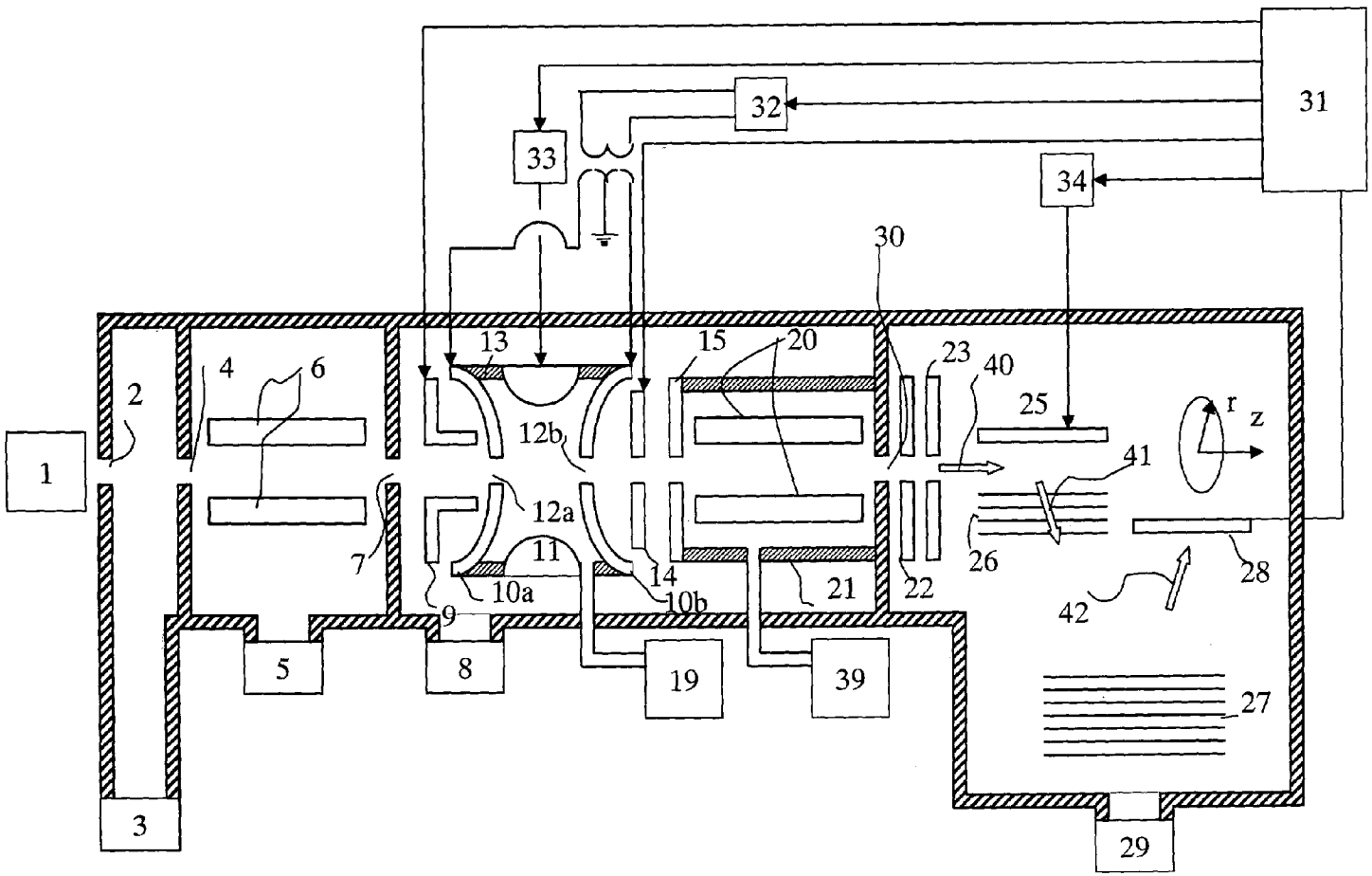
FIG. 1 is a diagram showing an atmospheric pressure quadrupole ion trap/time-of-flight mass spectrometer according to a first embodiment of the present invention.

FIG. 1 is a diagram showing the configuration of an atmospheric pressure ionization/quadrupole ion trap/time-of-flight mass spectrometer according to the present invention. Ions generated by an atmospheric pressure ionization source 1, such as an electro-spray ionization source, an atmospheric pressure chemical ionization source, an atmospheric pressure photo-ionization source or an atmospheric pressure matrix assisted laser ionization source, are passed through an orifice 2 and introduced into a first differential pumping region that has been evacuated by a rotary (vacuum) pump 3. The pressure of the first differential pumping region is approximately between 100 Pa and 500 Pa.

The ions are then passed through an orifice 4 and introduced into the second differential pumping region that has been evacuated by a turbo molecular pump 5. The pressure within the second differential pumping region is maintained at approximately between 0.3 Pa and 3 Pa, and multi-pole rods 6 (an octapole, a quadrupole, etc.) are disposed in the second differential pumping region. Radio frequency voltages of approximately 1 MHz, with a voltage amplitude of a few hundred volts and having alternately opposing phases, are applied to the multi-pole rods. Within the space surrounded by these multi-pole rods inside the multi-pole electrode, the ions gather around the center axis, and, therefore, they can be transferred with high transmission efficiency.

The ions which have converged due to the action of the multi-pole rods 6 (octapole, etc.) are passed through an orifice 7, a gate electrode 9, and an orifice 12*a* of an inlet endcap electrode 10*a*, and they are introduced into a quadrupole ion trap made up of endcap electrodes 10*a* and 10*b* and a ring electrode 11. The ion trap is shielded from the outside by an isolation spacer 13. A gas supplier 19, which is made up of a steel bottle and a flow controller, supplies He gas or Ar gas to the ion trap such that the pressure within the ion trap is kept constant (He: 0.6 Pa to 3 Pa; Ar: 0.1 Pa to 0.5 Pa). The higher the bath gas pressure within the ion trap is, the higher will be the ion trapping efficiency. However, the above pressure values are optimum values for the ion trap pressure, since a higher pressure reduces the mass resolution at the time of precursor ion isolation and necessitates a higher supplementary AC voltage to be applied to the endcap electrodes. The ions are subjected to processing, such as ion isolation and ion dissociation, by use of a method to be described later, making it possible to perform $MS^n$ analysis.

After the above-described processing is carried out within the ion trap, the ions are passed through an orifice 12*b* in the outlet endcap electrode 10*b*, the hole (of 3 mmϕ) in an ion stop electrode 14, and the orifice of an inlet electrode 15 of a collision damping chamber, and they are ejected into the collision damping chamber. When ions are ejected, a voltage is applied to the ion stop electrode 14 (a plurality of ion stop electrodes 14 may be employed) such that the ejected ions efficiently enter the orifice (of 2 mmϕ) of the inlet electrode 15 of the collision damping chamber. When ions are not ejected, on the other hand, a positive voltage (for positive ions) of between a few hundred volts and a few kilovolts is applied to the ion stop electrode 14 to prevent the ions from being transferred from the ion trap to the collision damping chamber. The collision damping chamber contains the multipole rods 20 (an octapole, hexapole, quadrupole, etc.) having a length of approximately between 0.02 m and 0.2 m. An orifice 30 between the collision damping (chamber) and the TOF region is a small hole having a size of approximately between 0.3 mmϕ and 0.8 mmϕ for maintaining the vacuum within the TOF region. The quadrupole electrode is most advantageous, since it can cause a beam to converge into a small width with a voltage of small amplitude.

The characteristics of a collision damping chamber according to the present invention will be described. The gas supplier 39, which is made up of a steel bottle and a flow controller, supplies He gas or Ar gas to the collision damping chamber such that the pressure within the collision damping chamber is kept constant.

Figure 2:
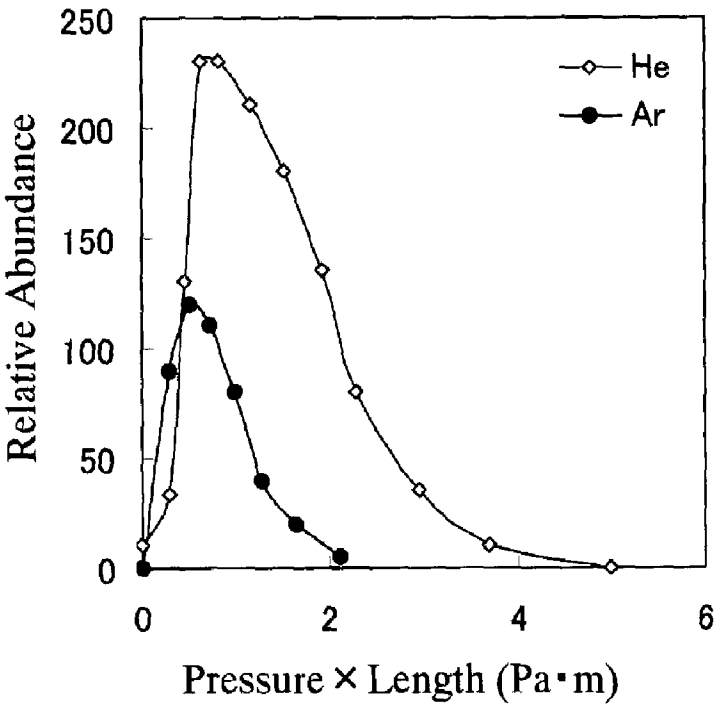
FIG. 2 is a graph showing transmission of ions in the collision-damping chamber in the first embodiment.

FIG. 2 shows the transmission efficiency of the collision damping chamber using a quadrupole for reserpine ions (609 amu). In FIG. 2, the horizontal axis indicates the product of the pressure and the length, which is generally used as a parameter for the damping effect. In this example, the z-direction length of the collision damping chamber is 0.08 m and the orifice between the collision damping chamber and the TOF region is 0.4 mm ϕ. As shown in FIG. 2, the transmission is high when the product of the length and the pressure of the collision damping chamber is between 0.2 Pa*m and 5 Pa*m for He gas and between 0.07 Pa*m and 2 Pa*m for Ar gas.

Figure 3:
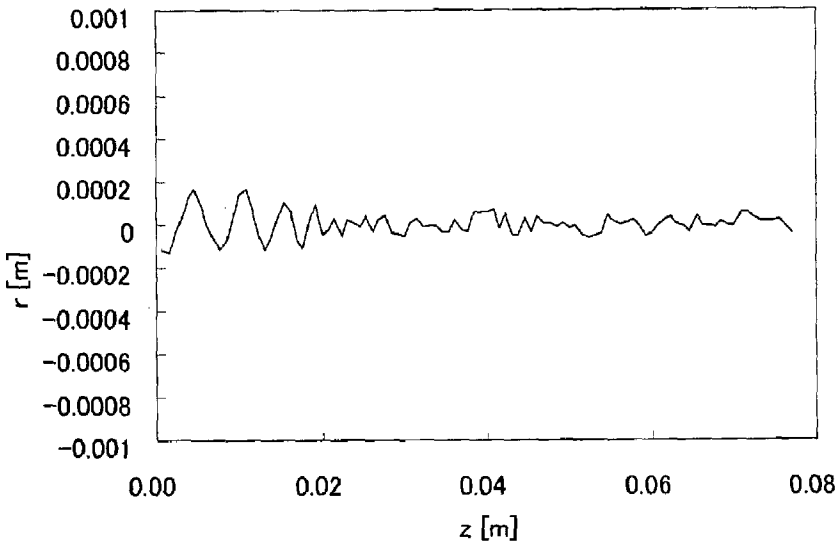
FIG. 3 is a graph showing simulation results of ion orbits through the collision-damping chamber in the first embodiment.

FIG. 3 shows a simulated ion path when ions go through a damping chamber whose sensitivity (the product of its length and pressure) is 1.3 Pa*m using He gas. In FIG. 3, the horizontal axis indicates the z-direction distance (referred to in FIG. 1) from the inlet of the damping chamber, while the vertical axis indicates the r-distance(referred to in FIG. 1) from the center of the multi-pole field. As shown in FIG. 3, the ion path converges as the ions undergo a damping action.

Figure 4:
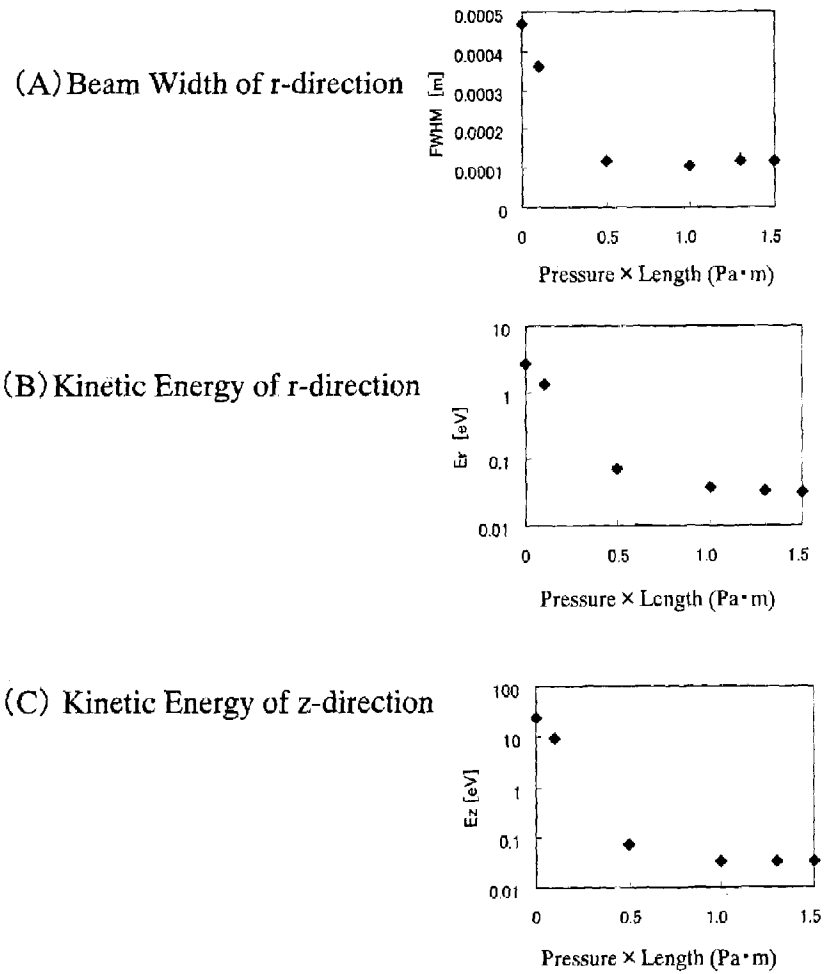
FIG. 4 is a series of graphs showing the simulation results in the first embodiment.

FIG. 4 shows the simulation results of the width (FWHM, A) of the ion beam at the rear end of the collision damping chamber and the kinetic energy of the ions in the (B)r-direction(Er) and (C)z-directions(Ez) in this First Embodiment.

In this simulation, if the product exceeds 0.3 Pa*m, the beam (diameter) converges and the kinetic energy approaches value, corresponding to the room temperature, of 0.026 eV. The simulation results nearly match the experimental results shown in FIG. 2 in which the ion intensity (signal intensity) exhibits a rapid increase. It is considered that, when the damping effect is too small, the ions are not sufficiently decelerated, and, therefore, they cannot go through the orifice 30 (of 0.4 mm ϕ) at the rear end, resulting in reduced sensitivity. When the damping effect is too large, on the other hand, the time during which the ions stay in the collision damping chamber becomes long, and, therefore, the transmission of the ions is reduced due to the reaction and the scattering therein. Accordingly, a high transmission is obtained when the product of the length and the pressure of the collision damping chamber is between 0.2 Pa*m and 5 Pa*m for He gas and between 0.07 Pa*m and 2 Pa*m for Ar gas.

The above-described example, in which the pressure is optimized, uses only He gas or Ar gas. In the case of $N_2$ (whose molecular weight is 32) or air (whose average molecular weight is 32.8), since the gas collision effect is dependent on the average molecular weight of the employed gas, it is considered that these gasses produce substantially the same results as those for Ar gas (whose molecular weight is 40). It should be noted that a mixture of these gasses may be used. He gas and Ar gas are suitable as an introduction gas since they have low reactivity.

Figure 5:
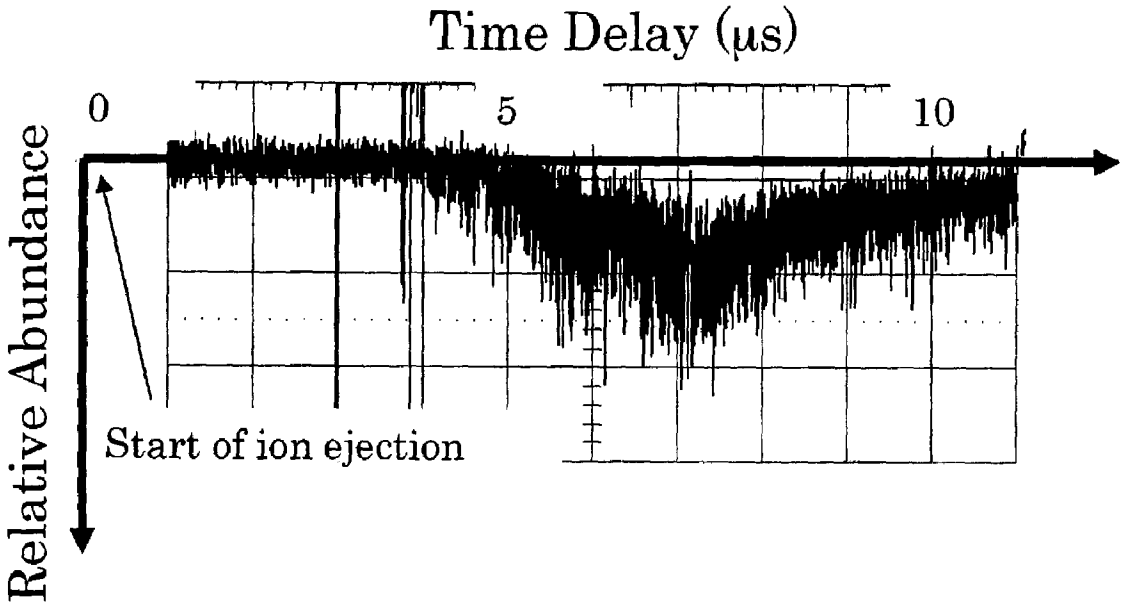
FIG. 5 is a graph showing the signal intensity measured at the inlet of the collision damping chamber in the first embodiment.

FIG. 5 shows the signal intensity of reserpine ion (m/z=609) measured at the inlet of the collision damping chamber. In FIG. 5, the horizontal axis indicates the time delay from the start of ion ejection from the ion trap, and the vertical axis indicates the relative abundance of ions. At that time, a voltage of +50 V is applied to the inlet endcap electrode 10*a*; +50 V is applied to the ring electrode 11; −30 V is applied to the outlet endcap electrode 10*b*; and −100 V is applied to the ion stop electrode 14. It can be seen from FIG. 5 that the ions, which were in the center portion of the ion trap, reach the inlet of the collision damping chamber within 10 μs. This arrival time is considered to be nearly proportional to the square root of the (ion) mass. Therefore, to transmit ions having masses up to 1,000,000, it is necessary to set the voltage that is applied to the ion stop electrode 14 such that the ions can enter the collision damping chamber for approximately 400 μs.

Figure 6:
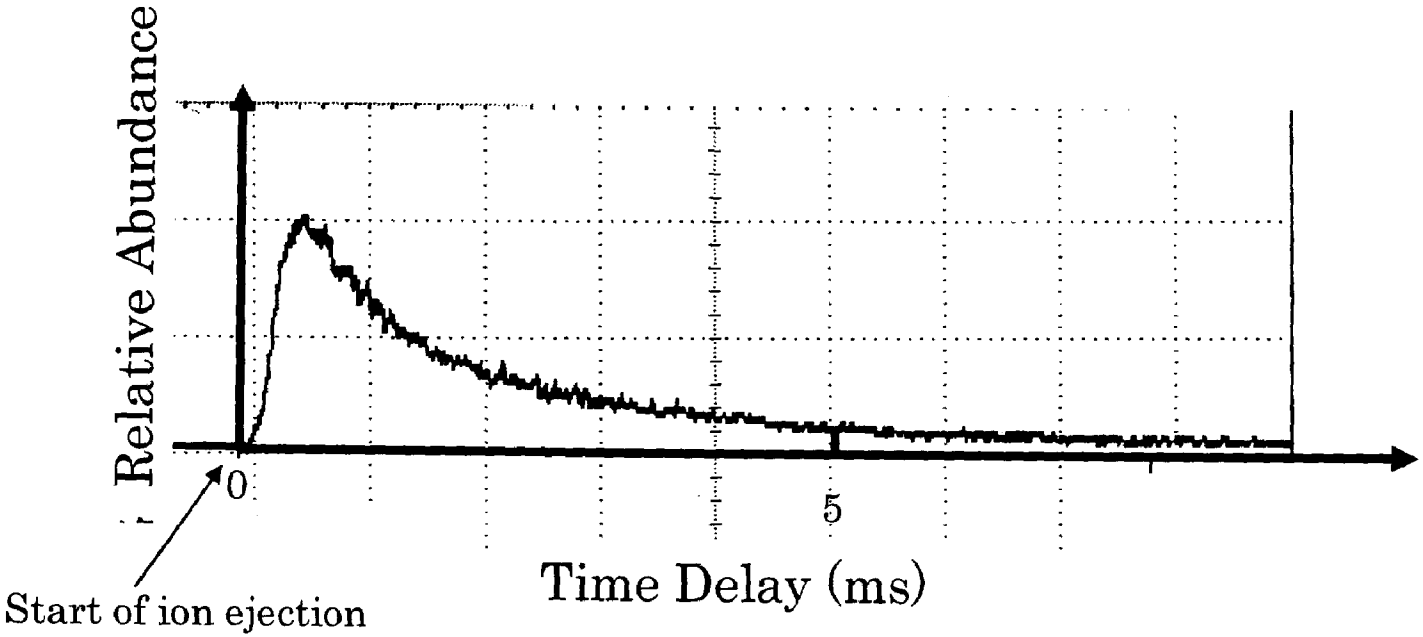
FIG. 6 is a graph showing the signal intensity measured at the exit of the collision damping chamber in the first embodiment.

FIG. 6 shows the signal intensity of reserpine ions (m/z=609) measured at the exit of the collision damping chamber. In FIG. 6, the horizontal axis indicates the time delay from the start of ion ejection from the ion trap, and the vertical axis indicates the relative abundance of ions. The ions are ejected during the period from 0.1 ms to 10 ms with the peak of the ejection occurring at around 0.5 ms. Employing such a collision damping chamber requires the application of a positive voltage (for positive ions), of between a few hundred volts and a few thousand volts, to the ion stop electrode 14 when ions are not ejected, so as to prevent unwanted ions from entering the collision damping chamber. Otherwise, noise ions, which are ejected at the time of ion accumulation, isolation, dissociation, etc., and which should not be subjected to measurement, are introduced into the collision damping chamber. These noise ions stay within the collision damping chamber for approximately 10 ms. Therefore, to prevent these ions from being mixed with the ions ejected in the ordinary ion ejection period, a waiting time must be set before the ordinary ion ejection so as to wait until all noise ions have been ejected. Providing this wait time reduces the number of times the measurement can be repeated per unit time (duty cycle), resulting in reduced sensitivity. According to the present invention, however, a voltage for allowing the passage of ions is applied to the ion stop electrode at the time of ion ejection, and a voltage for blocking the passage is applied at other times, making it possible to prevent the reduction of the duty cycle.

The ions that have been ejected into the TOF region are subjected to 15 deflection and convergence (for their positions and energy) by an ion deflector 22, a focus lens 23, etc., and they are transferred in an ion traveling direction 40 to the acceleration section (region) that is made up of a push electrode 25 and a pull electrode 26. The ions introduced into the acceleration region are accelerated in an orthogonal direction at approximately 10 kHz intervals. The ion incident energy to the acceleration region and the energy obtained by the acceleration are set such that the ion traveling direction 41 (after the deflection) is at an angle of approximately between 70° and 90° with respect to the original ion traveling direction 40. The accelerated ions are reflected by a reflectron 27 into an ion traveling direction 42, so as to reach a detector 28 that is made up of a multichannel plate (MCP), etc., which then detects the ions. Since the ions each exhibit a different flight time depending on the individual mass thereof, a controller 31 records the mass spectrum using the flight time and the signal intensity of each ion.

Figure 7:
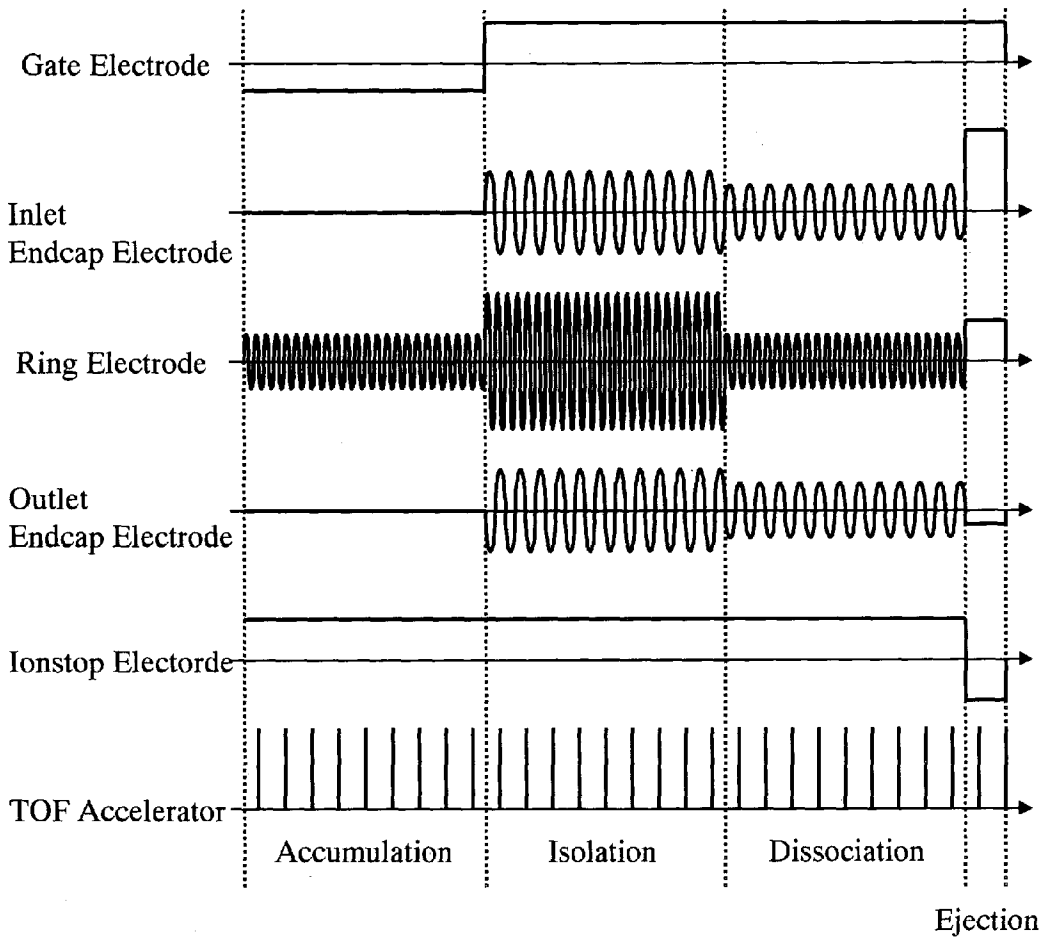
FIG. 7 is a timing diagram showing an example of the MS/MS measurement sequence of the first embodiment.

An example of the measurement sequence used to carry out MS/MS measurement according to the present invention will be described with reference to FIG. 7. This method performs operations such as (ion) accumulation, isolation, dissociation, and ejection at given (four) timings. The controller 31 controls the voltages applied to a power supply 33 for the ring electrode 11, a power supply 32 for the endcap electrodes 10*a*, 10*b*, a power supply 34 for the acceleration voltage; and the controller also controls the inlet gate electrode 9 and the ion stop electrode 14. Furthermore, the ion intensity detected by the detector 28 is sent to the controller 31 which then records the ion intensity as mass spectrum data.

An example of how to apply these voltages for positive ions will be described. It should be noted that for negative ions, voltages of opposite polarity are applied. To obtain an ordinary mass spectrum ($MS^1$), the operations from the ion introduction to the ion ejection are performed according to the above measurement sequence. In the case of $MS^n$ ($n \geqq 3$) measurement, isolation and dissociation processes are repeated between the dissociation and the ejection in the MS/MS measurement sequence.

An AC voltage (having a frequency of approximately 0.8 MHz and an amplitude of between 0 and 10 kV) that is generated by the power supply 33 for the ring voltage is applied to the ring electrode 13 at the time of ion accumulation. During this period, ions generated by the ionization source that have passed through each region are accumulated into the ion trap. A typical value for the ion accumulation time is approximately between 1 ms and 100 ms. If the accumulation time is too long, a phenomenon called "ion space charge" occurs, which disturbs the electric field within the ion trap. Therefore, the accumulation operation is ended before this phenomenon occurs. At the time of the accumulation, a negative voltage is applied to the gate electrode so as to allow for the passage of ions. On the other hand, a positive voltage of between a few hundred volts and a few thousand volts is applied to the ion stop electrode so as to prevent ions from being introduced into the collision damping chamber.

Then, desired precursor ions are isolated. For example, a voltage superposed with high frequency components, exclusive of the frequency components corresponding to the secular motions of the desired ions, is applied between the endcap electrodes to eject the other ions to the outside and, thereby, leave only a certain mass range of ions within the ion trap. Even though there are various types of ion isolation methods other than the one described, they all have the same purpose of leaving only a certain mass range of precursor ions. The time typically required for ion isolation is approximately between 1 ms and 10 ms. During that period, a positive voltage of between a few hundred volts and a few thousand volts is applied to the ion stop electrode, so as to prevent ions from being introduced into the collision damping chamber.

Then, the isolated precursor ions are dissociated. A supplementary AC voltage resonating with the precursor ions is applied between the endcap electrodes to extend the path of the precursor ions. This increases the internal temperature of the ions, which eventually leads to dissociation of the ions. The time typically required for ion dissociation is between 1 ms and 30 ms. During that period, a positive voltage of between a few hundred volts and a few thousand volts is applied to the ion stop electrode so as to prevent ions from being introduced into the collision damping chamber.

Lastly, ion ejection is carried out. DC voltages are applied to the inlet endcap electrode 10*a*, the ring electrode 11, and the outlet endcap electrode 10*b* so as to produce an electric field in the z-direction within the ion trap at the time of ion ejection. Since the time required for the ejection from the ion trap is 1 ms or less, as described above, there is little reduction in the duty cycle for the entire measurement. All of the ions ejected from the trap are introduced into the collision damping chamber within 1 ms. The ions are then ejected from the rear end of the collision damping chamber with a time spread of a few milliseconds. The next accumulation process is started in the ion trap before the ejection from the collision damping chamber to the TOF region has been completed. The time typically required for ion ejection is between 0.1 ms and 1 ms.

The ions ejected from the collision damping chamber are accelerated by the acceleration region, which is operated at 10 kHz out of synchronization with the ion trap. After that, the detector records the mass spectrum. Ideally, the spectrum is transmitted to the controller each time it is recorded. However, recorded spectra may be stored in a high-speed memory and then transmitted to the controller in synchronization with the timing of the ion ejection, which reduces the burden on the transmission. The transmitted mass spectra are recorded by the controller 31.

Figure 8:
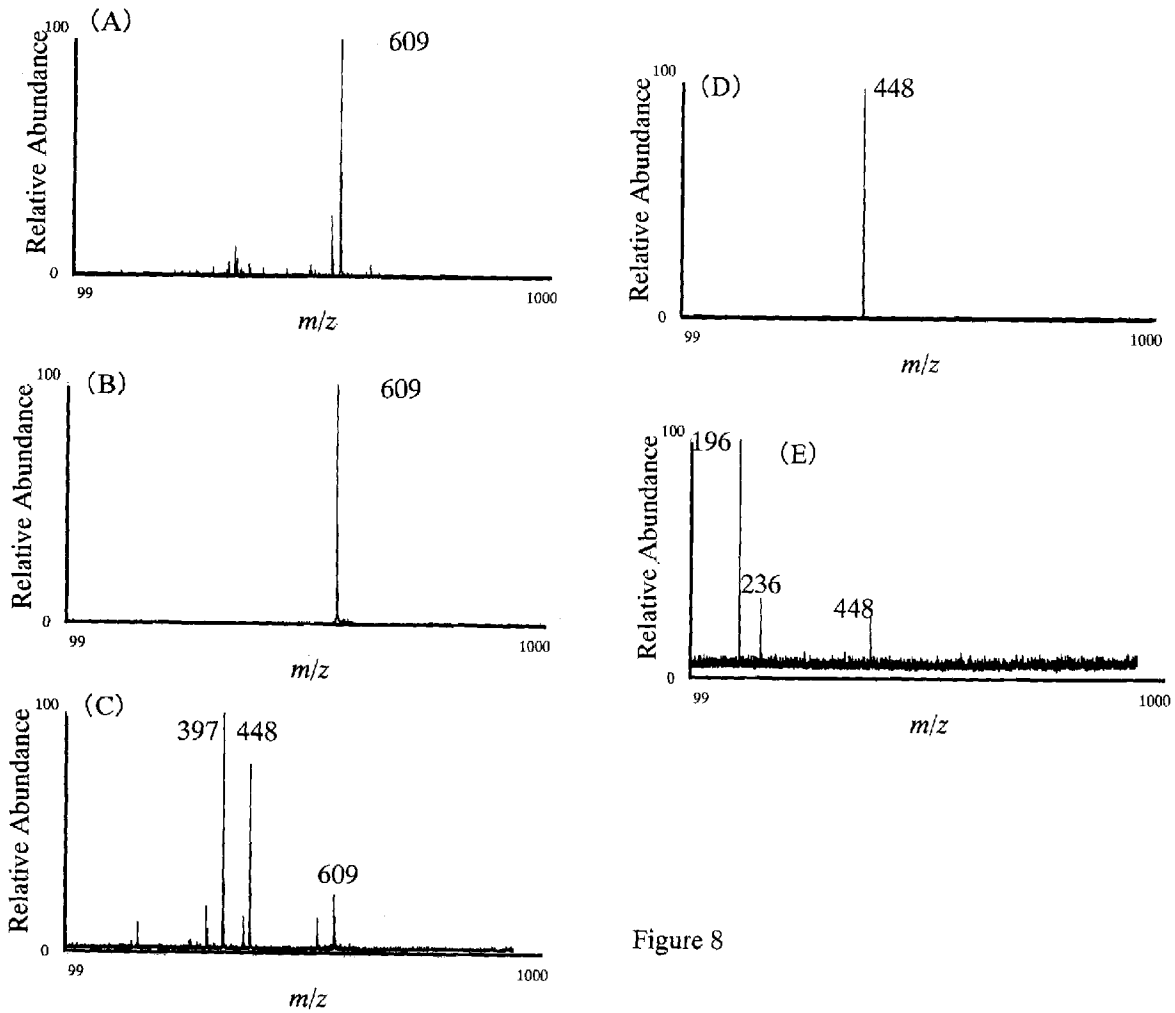
FIG. 8 is a series of graphs showing the $MS^3$ spectra analyzing reserpine/metahanol solution of the first embodiment.

FIG. 8 includes graphs (A) to (E) showing $MS^3$ measurement results of a reserpine/methanol solution obtained by use of a mass spectrometer of the present invention. Graph (A) shows an ordinary mass spectrum ($MS^1$). The peak of reserpine ions (609 amu) and several noise ion peaks can be observed. Graph (B) shows a mass spectrum obtained after isolating reserpine ions (609 amu), wherein other ions have been ejected out of the ion trap. Graph (C) shows a mass spectrum of ions obtained as a result of dissociating reserpine ions ($MS^2$). Ions of 397 amu and 448 amu and other several ions produced through the dissociation are detected. Graph (D) shows a mass spectrum obtained after isolating ions of 448 amu from the fragment ions. Ions other than the ions of 448 amu have been ejected out of the ion trap. Graph (E) shows a mass spectrum obtained after dissociating the ions of 448 amu ($MS^3$). Ions of 196 amu and 236 amu, which are fragment ions, can be observed. Though not shown, these ions may also be isolated and dissociated. Such high-level $MS^n$ analysis makes it possible to obtain detailed structural information on sample ions, which it has not been possible to obtain heretofore through use of ordinary mass spectrometry or an MS/MS analysis, thereby resulting in analysis with high precision. It should be noted that with the above-described arrangement, a mass resolution of 5,000 or more and a mass accuracy of 10 ppm or less were achieved for reserpine ions.

Figure 9:
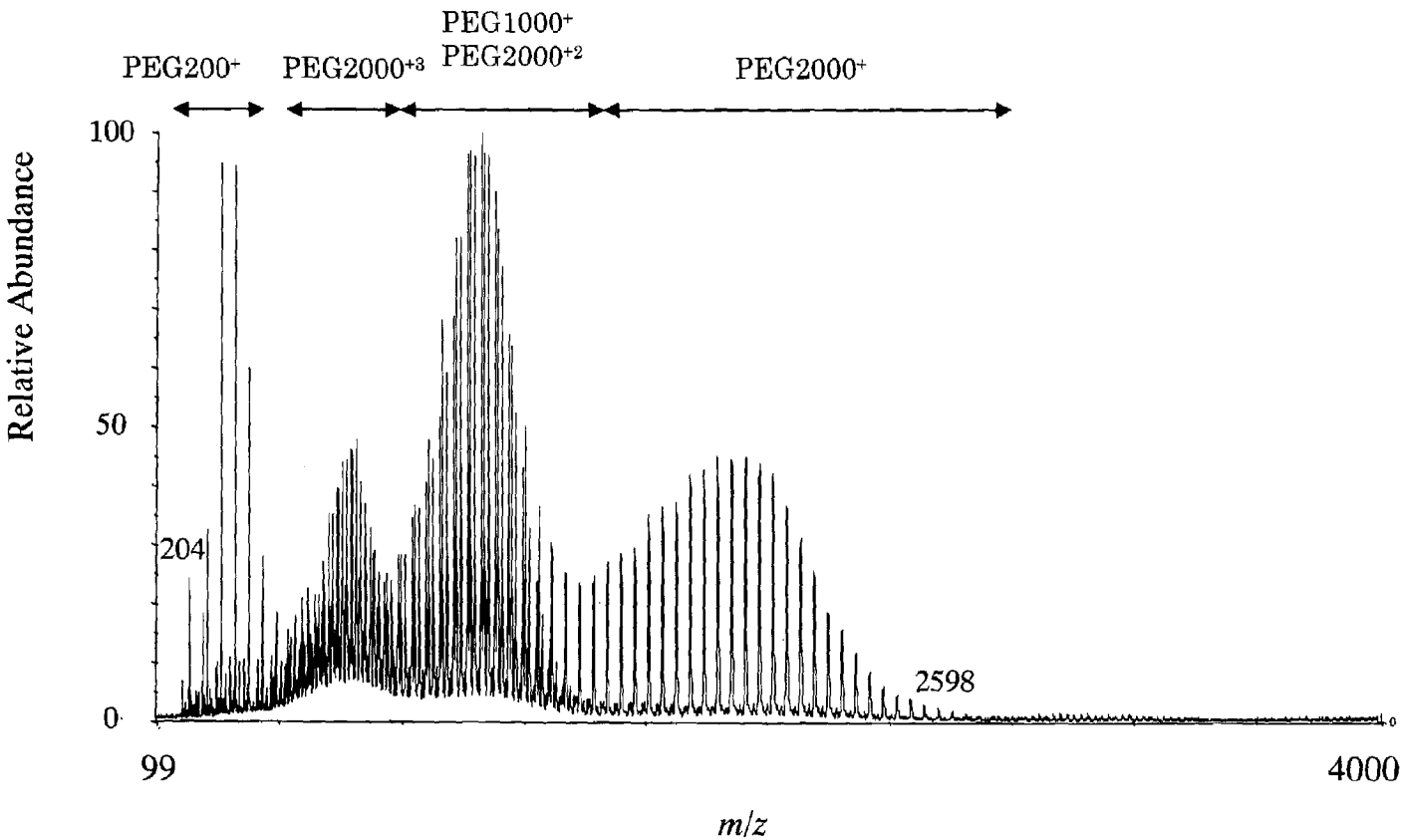
FIG. 9 is a graph showing the mass spectrum of the analyzing polyethylene glycol (PEG)/methanol solution of the first embodiment.

FIG. 9 shows a mass spectrum of a polyethylene glycol (PEG)/methanol solution. A wide mass range of ions, approximately from 200 amu to 2,600 amu, is detected in a single measuring process. Conventional ion trap orthogonal TOFs have not been able to detect these ions.

Second Embodiment

Figure 10:
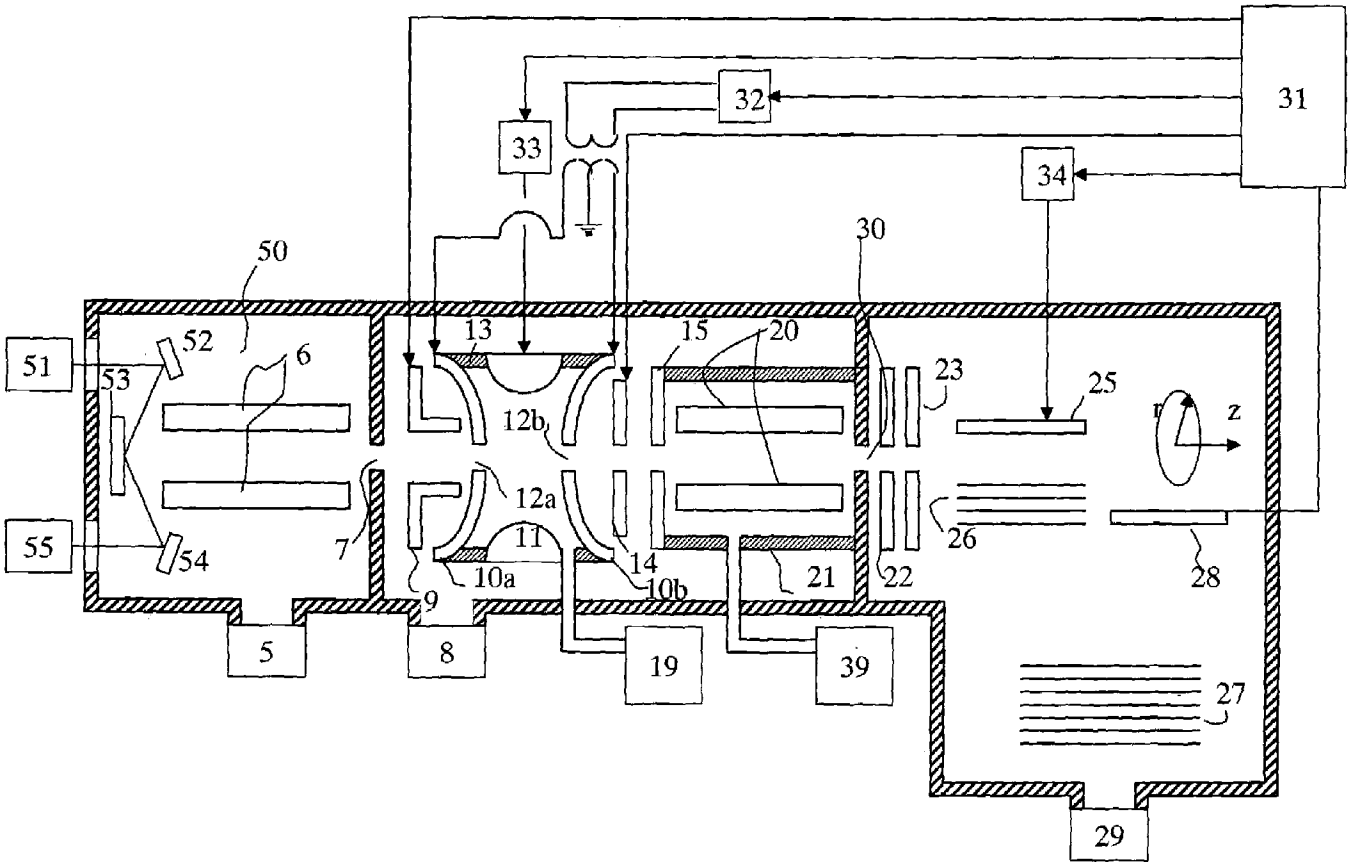
FIG. 10 is a diagram showing a matrix-assisted laser ionization—quadrupole ion trap/time-of-flight mass spectrometer according to a second embodiment of the present invention.

FIG. 10 is a diagram showing the configuration of a matrix assisted laser ionization/quadrupole ion trap/time-of-flight mass spectrometer according to a second embodiment of the present invention. Laser 51 for ionization (nitrogen laser, etc.) irradiates a laser beam via a reflector 52 onto a sample plate 53, which has been produced as a result of mixing a sample solution and a matrix solution and then dropping and desiccating the mixed solution. The irradiation position is checked by use of a CCD camera 55, which detects the reflected beam via reflector 54. The generated ions are trapped and transferred by multi-pole rods 6. An ionization chamber 50 is evacuated by a pump 5 to a pressure of approximately between 1 and 100 mTorr. The subsequent analyzing steps of the operation are the same as those employed for the first embodiment, and so the structure of the mass spectrometer downstream of the chamber 50 is the same as that of FIG. 1. Other laser ionization sources such as an SELDI and a DIOS can be applied to the present invention in the same manner.

The present invention provides a mass spectrometer that is capable of measuring a wide (ion) mass range in a single measuring process without repeating it, while achieving high sensitivity, high mass accuracy, and $MS^n$ ($n \geqq 3$) analysis.

While the invention has been described with reference to various preferred embodiments, it is to be understood that the words, which have been used herein to describe the invention, are words of description rather than limitation, and that changes within the purview of the appended claims may be made without departing from the true scope and spirit of the invention.

What is claimed is:

1. A mass spectrometer comprising:

an ionization source for generating ions;

an ion trap for accumulating said ions, wherein a gas is introduced into said ion trap;

a time-of-flight mass spectrometer for performing mass spectrometry analysis on said ions by use of a flight time;

a collision damping chamber disposed between said ion trap and said time-of-flight mass spectrometer and having a plurality of electrodes therein which produce a multi-pole electric field, a gas being introduced into said collision damping chamber; and an ion stop electrode provided between said ion trap and said collision damping chamber;

wherein a voltage for allowing the passage of ions is applied to said ion stop electrode during a period of ion ejection from said ion trap, and a voltage for blocking the passage of ions is applied to said ion stop electrode during a period of at least one of ion accumulation, ion isolation and ion dissociation in said ion trap so that the ions from said ion trap are prevented from entering into said collision damping chamber;

wherein a gas supply mechanism is provided for each of said ion trap and said collision damping chamber.

2. The mass spectrometer as claimed in claim 1, wherein said ion trap is a three-dimensional quadrupole ion trap made up of a ring electrode and a pair of endcap electrodes.

3. The mass spectrometer as claimed in claim 1, wherein said gas introduced into said collision damping chamber is helium; and a product of a pressure and a length of said collision damping chamber is between 0.2 Pa*m and 6 Pa*m.

4. The mass spectrometer as claimed in claim 1, wherein said gas introduced into said collision damping chamber is Ar, air, or nitrogen, or a mixture thereof; and a product of a pressure and a length of said collision damping chamber is between 0.07 Pa*m and 2 Pa*m.

5. The mass spectrometer as claimed in claim 1, wherein said plurality of electrodes in said collision damping chamber which produce said multi-pole electric field are 4, 6, or 8 rods; and a radio frequency voltage is alternately applied to said 4, 6, or 8 rods.

6. The mass spectrometer as claimed in claim 1, wherein said ionization source is disposed such that it is under atmospheric pressure.

7. The mass spectrometer as claimed in claim 1, wherein said ionization source is a laser ionization source.

8. The mass spectrometer as claimed in claim 7, wherein said ionization source is a matrix assisted laser ionization source.

9. The mass spectrometer as claimed in claim 1, wherein the voltage for blocking the passage of the ions is between a few hundred volts and a few thousand volts.

10. The mass spectrometer as claimed in claim 1, wherein a trapping potential for trapping the ions in said ion trap is applied to said ion trap.

11. The mass spectrometer as claimed in claim 1, wherein a gas pressure in said collision damping chamber is higher than a gas pressure in said ion trap.

* * * * *